US009912079B2

(12) United States Patent
Hartenstein

(10) Patent No.: US 9,912,079 B2
(45) Date of Patent: Mar. 6, 2018

(54) DISTRIBUTED OMNI-DUAL-BAND ANTENNA SYSTEM FOR A WI-FI ACCESS POINT

(71) Applicant: Xirrus, Inc., Thousand Oaks, CA (US)

(72) Inventor: Abraham Hartenstein, Chatsworth, CA (US)

(73) Assignee: Xirrus, Inc., Thousand Oaks, CA (US)

( * ) Notice: Subject to any disclaimer, the term of this patent is extended or adjusted under 35 U.S.C. 154(b) by 83 days.

(21) Appl. No.: 14/792,574

(22) Filed: Jul. 6, 2015

(65) Prior Publication Data

US 2016/0043478 A1 Feb. 11, 2016

Related U.S. Application Data

(60) Provisional application No. 62/020,856, filed on Jul. 3, 2014.

(51) Int. Cl.

| | |
|---|---|
| ***H01Q 21/00*** | (2006.01) |
| ***H01Q 21/30*** | (2006.01) |
| ***H01Q 1/22*** | (2006.01) |
| ***H01Q 21/20*** | (2006.01) |
| *H01Q 19/10* | (2006.01) |
| *H01Q 9/42* | (2006.01) |

(52) U.S. Cl.
CPC ..... *H01Q 21/30* (2013.01); *H01Q 1/2291* (2013.01); *H01Q 21/205* (2013.01); *H01Q 9/42* (2013.01); *H01Q 19/10* (2013.01)

(58) Field of Classification Search
CPC ..... H01Q 19/32; H01Q 21/06; H01Q 3/18; H01Q 1/125; H01Q 19/19; H01Q 21/26
USPC ..... 343/835, 839, 910, 908, 797
See application file for complete search history.

(56) References Cited

U.S. PATENT DOCUMENTS

| | | | | |
|---|---|---|---|---|
| 2004/0027309 | A1* | 2/2004 | Swarup | H01Q 1/005 343/912 |
| 2006/0109067 | A1* | 5/2006 | Shtrom | H01P 1/185 333/164 |
| 2010/0119002 | A1* | 5/2010 | Hartenstein | H01Q 21/24 375/267 |

* cited by examiner

*Primary Examiner* — Dameon E Levi
*Assistant Examiner* — Collin Dawkins
(74) *Attorney, Agent, or Firm* — Socal IP Law Group, LLP; John E. Gunther; Steven C. Sereboff

(57) ABSTRACT

A distributed broadband, omni-dual-band monopole antenna system for use in a Wi-Fi access point. The distributed omni-dual-band antenna system may include an antenna array that includes 4, 6, or 8 monopole antennas arranged in a circular array fashion along the perimeter of the access point. Each monopole antenna may be associated with a single Wi-Fi radio of the access point, and each of the antennas for the different radios are interleaved in order to provide omni-coverage with minimal distortion; that is, each antenna of the access point is alternated with antennas for different radios. A broadband printed omni-dual-band monopole antenna comprising three horizontal radiating elements arranged in an S-shape and a single vertical radiating element connected to the bottom-most horizontal radiating element is also disclosed.

10 Claims, 12 Drawing Sheets

DISTRIBUTED OMNI-DUAL-BAND ANTENNA SYSTEM FOR A WI-FI ACCESS POINT

CROSS-REFERENCE TO RELATED APPLICATION

This application claims priority of United States ("U.S.") Provisional Patent Application Ser. No. 62/020,856, entitled "Distributed Omni-Dual Band Antenna System for a Wi-Fi Access Point," filed on Jul. 3, 2014, to inventor Abraham Hartenstein, the disclosure of which is incorporated by reference herein in its entirety.

BACKGROUND OF THE INVENTION

1. Field of the Invention

The present invention relates generally to antenna systems utilized in Wi-Fi devices, and more particularly, to a distributed omni-directional dual-band antenna system for use in smaller Wi-Fi devices.

2. Related Art

The use of wireless communication devices for data networking is growing at a rapid pace. Data networks that use "Wi-Fi" ("Wireless Fidelity") are relatively easy to install, convenient to use, and supported by the IEEE 802.11 standard. Wi-Fi data networks also provide performance that makes Wi-Fi a suitable alternative to a wired data network for many business and home users.

Wi-Fi networks operate by employing wireless access points that provide users, having wireless (or "client") devices in proximity to the access point, with access to varying types of data networks such as, for example, an Ethernet network or the Internet. The wireless access points may include one or more radios that operate according to one of three standards specified in different sections of the IEEE 802.11 specification. Generally, radios in the access points communicate with client devices by utilizing omni-directional antennas that allow the radios to communicate with client devices in any direction. The access points are then connected (by hardwired connections) to a data network system that completes the access of the client device to the data network.

The three standards that define the radio configurations are:

1. IEEE 802.11a, which operates on the 5 GHz frequency band with data rates of up to 54 Mbs;
2. IEEE 802.11b, which operates on the 2.4 GHz frequency band with data rates of up to 11 Mbs; and
3. IEEE 802.11g, which operates on the 2.4 GHz frequency band with data rates of up to 54 Mbs.

The 802.11b and 802.11g standards provide for some degree of interoperability. Devices that conform to the 802.11b standard may communicate with 802.11g access points. This interoperability comes at a cost as access points will switch to the lower data rate of 802.11b if any 802.11b devices are connected. Devices that conform to the 802.11a standard may not communicate with either 802.11b or 802.11g access points. In addition, while the 802.11a standard provides for higher overall performance, 802.11a access points have a more limited range of approximately 60 feet compared with the approximate 300 feet range offered by 802.11b or 802.11g access points.

Each standard defines 'channels' that wireless devices, or clients, use when communicating with an access point. The 802.11b and 802.11g standards each allow for 14 channels. The 802.11a standard allows for 23 channels. The 14 channels provided by the 802.11b and 802.11g standards include only 3 channels that are not overlapping. The 12 channels provided by the 802.11a standard are non-overlapping channels.

Access points provide service to a limited number of users. Access points are assigned a channel on which to communicate. Each channel allows a recommended maximum of 64 clients to communicate with the access point. In addition, access points must be spaced apart strategically to reduce the chance of interference, either between access points tuned to the same channel, or to overlapping channels. In addition, channels are shared. Only one user may occupy the channel at any given time. As users are added to a channel, each user must wait longer for access to the channel thereby degrading throughput.

Another degradation of throughput as the number of clients grows is the result of the use of omni-directional antennas. Unfortunately, current access point technology employs typically one or two radios in close proximity that results in interference, which reduces throughput. In an example of a two radio access point, both radios may be utilized as access points (i.e., each radio communicates with a different client device) or one radio may function as the access point while the other radio functions as a backhaul, i.e., a communication channel from the access point to a network backbone, central site, and/or other access point. Typically, the interference resulting from the different antennas utilized with these radios limits the total throughput available and, as a result, reduces traffic efficiency at the access point.

In existing Wi-Fi technologies, there is a need to deploy mesh-like networks of access points to increase the coverage area of a Wi-Fi communication system. As the number of access points increases so does the complexity of implementing the communication system. Therefore, there is a need for a radio and antenna architecture capable of operating in mesh-like networks of access points without causing radio interference that reduces the throughput of the network.

Unfortunately, because of the compact size of access points in Wi-Fi communication systems, it may be difficult to design antennas that are capable of providing the coverage needed by these types of systems, especially when omni-directional coverage is needed. As an example, when deploying an access point with omni-directional coverage using omni-directional antennas, the azimuth coverage is distorted due to the presence of the antennas and their overlapping radiation patterns. Due to the fact that there are two radios that could be operating in a 2×2, 3×3, or 4×4 architecture, there may be 4, 6, or 8 antennas, respectively, used in a small volume. The close proximity of these antennas will affect the isolation between the antennas and the radios, preventing them from coexisting while operating at, for example, a 5 GHz band. Therefore, there is a need for a distributed omni-directional dual-band antenna system with improved isolation between antennas for use in a Wi-Fi access point.

SUMMARY

In view of the above, a distributed broadband omni-directional dual-band antenna system for use in a Wi-Fi access point (AP) is described. The distributed broadband omni-directional dual-band antenna system may include an antenna array that includes 4, 6, or 8 antennas arranged in a circular array fashion along the perimeter of the Wi-Fi AP. Each antenna may be associated with a single Wi-Fi radio of the AP, and each of the antennas for the different radios are interleaved in order to provide omni-directional coverage with minimal distortion; that is, each antenna of the AP is alternated with antennas for different radios. Each antenna element in the array may be a broadband (3.5 to 7 GHz) dual-band (2.4 and 5-6 GHz) antenna and may also be semi-directional.

The elevation coverage of this monopole antenna is forward looking, that is, its main beam is more energy-focused along its main axis. This forward looking feature increases the isolation between the antennas and thus indirectly the isolation between the radios. The antenna gain in the 2.4 and 5 GHz bands may be 2-5 dB. The isolation between any antenna element in the array is high, reaching, for example, approximately 40 dB at the 5 GHz band. This high isolation between the antennas enables the two radios in the AP to coexist with each other.

Having the antennas interleaved creates an effect of distributed omni-directional coverage, where the two or three antennas connected to a specific radio form an omni-directional coverage for the AP. The antenna element may be a dual-band monopole antenna mounted on a ground plane. The ground plane may deflect the pattern down by about 10 degrees maximizing coverage below the antenna. The monopole element may also have a reflector behind it to enhance its directivity. The reflector may be a continuous metallic wall or a single wire reflector. The AP may be an integrated assembly and by properly designing its printed circuit board (PCB), antenna performance will not be affected by the presence of other components of the AP.

An improved design of a compact broadband microstrip-fed printed monopole antenna for use in the distributed omni-directional dual-band antenna system is also disclosed. The shape of the radiating elements of the microstrip-fed printed monopole antenna may be described as "a flared notch with folded stub." This monopole antenna generates a directional beam where the peak of the gain is along the main axis of the antenna where the peak gain may be 5.0 dBi and 2.8 dBi at 2.45 and 5 GHz, respectively.

Other systems, methods and features of the invention will be or will become apparent to one with skill in the art upon examination of the following figures and detailed description. It is intended that all such additional systems, methods, features and advantages be included within this description, be within the scope of the invention, and be protected by the accompanying claims.

BRIEF DESCRIPTION OF THE DRAWINGS

The examples of the invention described below can be better understood with reference to the following figures. The components in the figures are not necessarily to scale, emphasis instead being placed upon illustrating the principles of the invention. In the figures, like reference numerals designate corresponding parts throughout the different views.

DETAILED DESCRIPTION

In the following description of example embodiments, reference is made to the accompanying drawings that form a part of the description, and which show, by way of illustration, specific example embodiments in which the invention may be practiced. Other embodiments may be utilized and structural changes may be made without departing from the scope of the invention.

In general, a distributed omni-directional dual-band antenna system for use in a Wi-Fi access point is described. The distributed omni-directional dual-band antenna system includes an antenna array that may include 4, 6, or 8 antennas arranged in a circular array fashion along the Wi-Fi access point. Each antenna may be associated with a different Wi-Fi radio. The antennas for the different radios are interleaved (see FIGS. 1 and 2) in order to provide omni-directional coverage with minimal distortion. Each antenna element in the array may be dual-band one may also be semi-directional.

Figure 1:
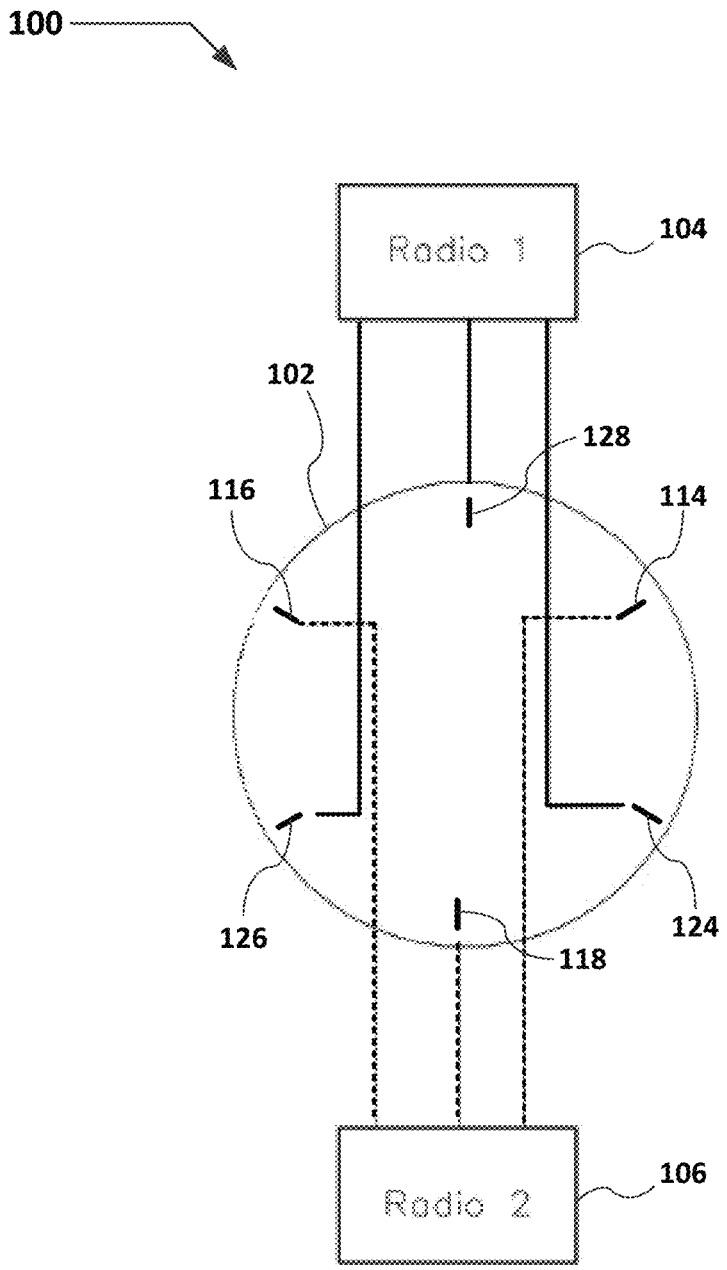
FIG. 1 is a schematic view of a two-radio architecture in a 3×3 access point (AP).
Figure 2:
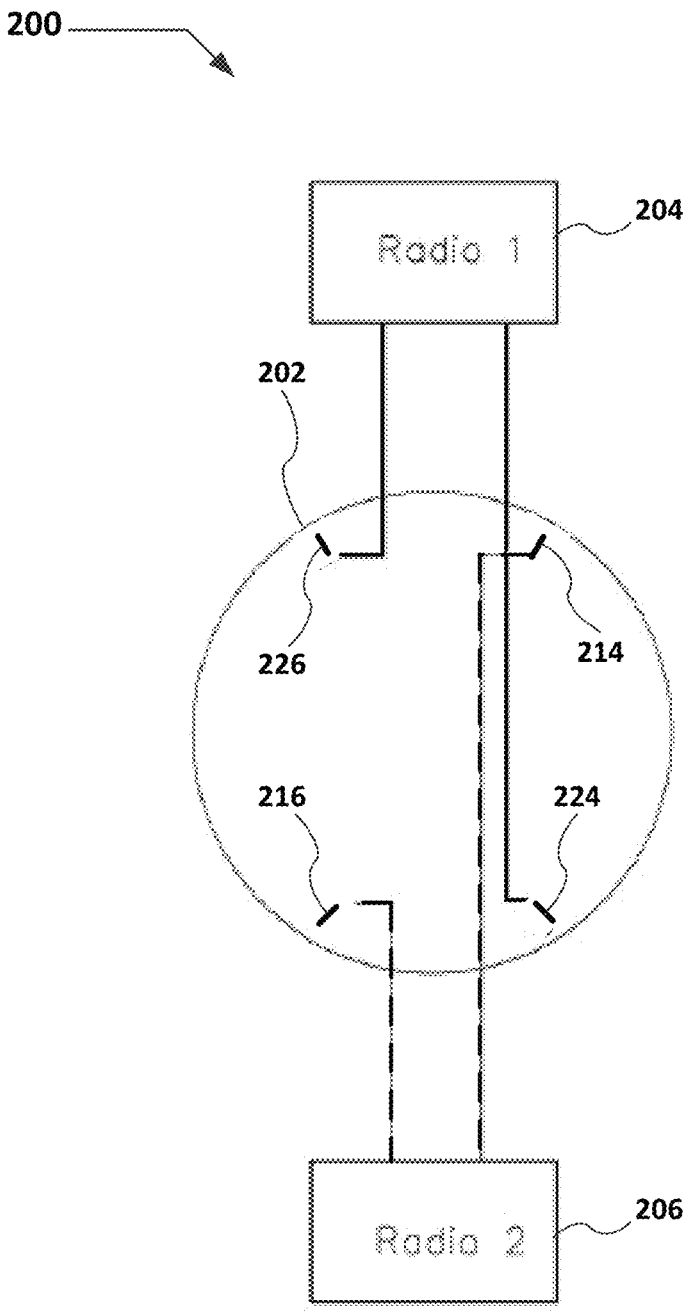
FIG. 2 is a schematic view of a two-radio architecture in a 2×2 AP.

FIGS. 1 and 2 show schematic views of a two radio architecture 100 in a 3×3 access point (AP) and a 2×2 AP, respectively, with two radios each. In FIG. 1, radio 104 is associated with three antennas 124, 126, and 128, and radio 106 is associated with three antennas 114, 116, and 118. Antennas 114, 116, 118, 124, 126, and 128 are all dual-band monopole antennas in accordance with the present invention, and are mounted at the perimeter of ground plane 102. Each of the antennas 114, 116, 118, 124, 126, and 128 is mounted width-wise on a radius of the ground plane 102 at equi-distances along the perimeter of the ground plane 102, and are interleaved, that is, antennas associated with each of the two radios are affixed in alternate positions around the perimeter.

Turning to FIG. 2, radio 204 is associated with two antennas 224 and 226, and radio 206 is also associated with two antennas 214 and 216. Antennas 214, 216, 224, and 226 are all dual-band monopole antennas in accordance with the present invention, and are mounted on ground plane 202. Each of the antennas 214, 216, 224, and 226 is mounted width-wise on a radius of the ground plane 202 at equidistances along the perimeter of the printed circuit board 102, and are also interleaved.

Figure 3:
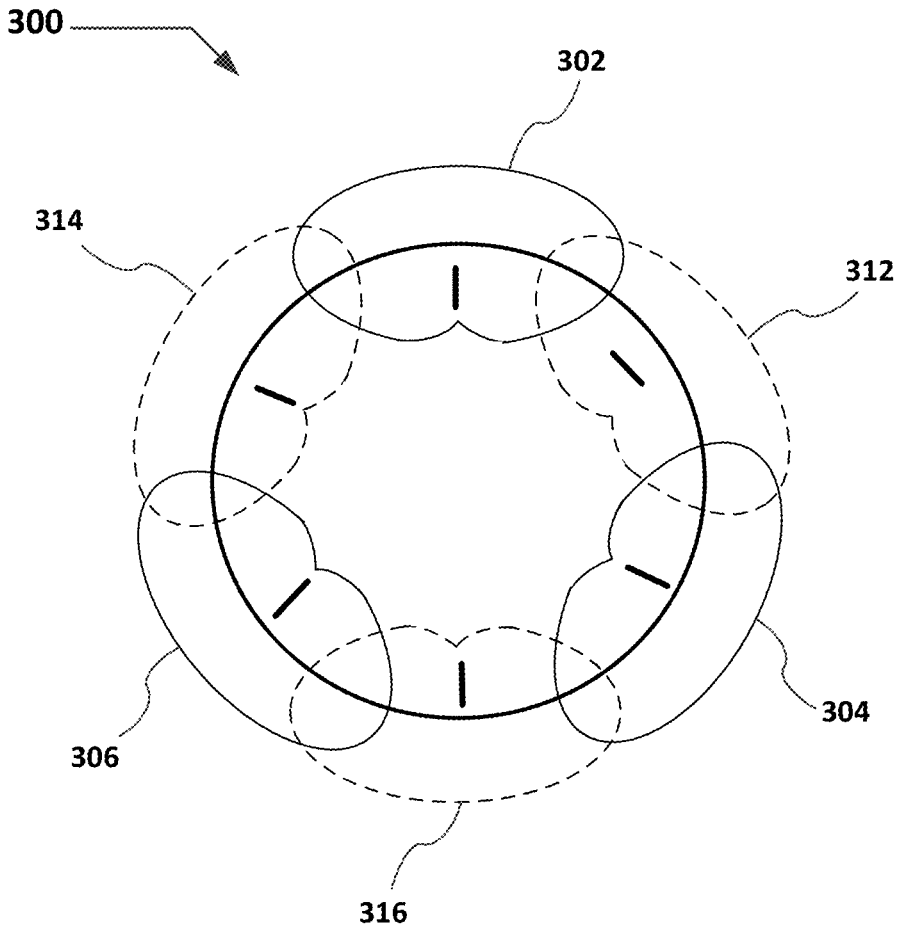
FIG. 3 is a top view of an example radiation pattern of the azimuth coverage for the two-radio interleaved 3×3 AP architecture of FIG. 1.

FIG. 3 shows a top view of an example radiation pattern of the azimuth coverage 300 for the two-radio interleaved 3×3 AP shown in FIG. 1. Radiation patterns 302, 304, and 306 are the azimuth plots for antennas 128, 124, and 126, respectively, that are shown in FIG. 1. Likewise, radiation patterns 312, 316, and 314 are the azimuth plots for antennas 114, 118, and 116, respectively, that are shown in FIG. 1. Together, these radiation patterns illustrate the omni-directional characteristics of the interleaved 3×3 AP described in FIG. 1.

Figure 4:
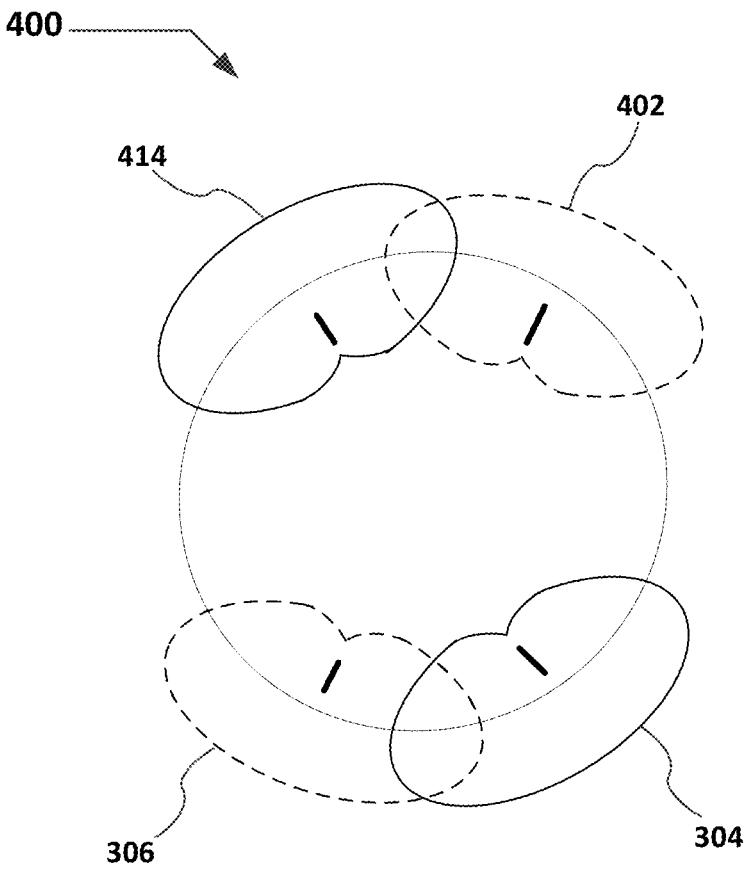
FIG. 4 is a top view of an example radiation pattern of the azimuth coverage for the two-radio interleaved 2×2 AP architecture of FIG. 1.

Turning to FIG. 4, a top view of an example radiation pattern of the azimuth coverage 400 for the two-radio interleaved 2×2 AP shown in FIG. 2. Radiation patterns 402 and 406 are the azimuth plots for antennas 214 and 216, respectively, that are shown in FIG. 2. Likewise, radiation patterns 404 and 408 are the azimuth plots for antennas 224 and 226, respectively, that are shown in FIG. 2. Here, these radiation patterns illustrate the distributed omni-directional characteristics of the interleaved 2×2 AP described in FIG. 2.

Figure 5:
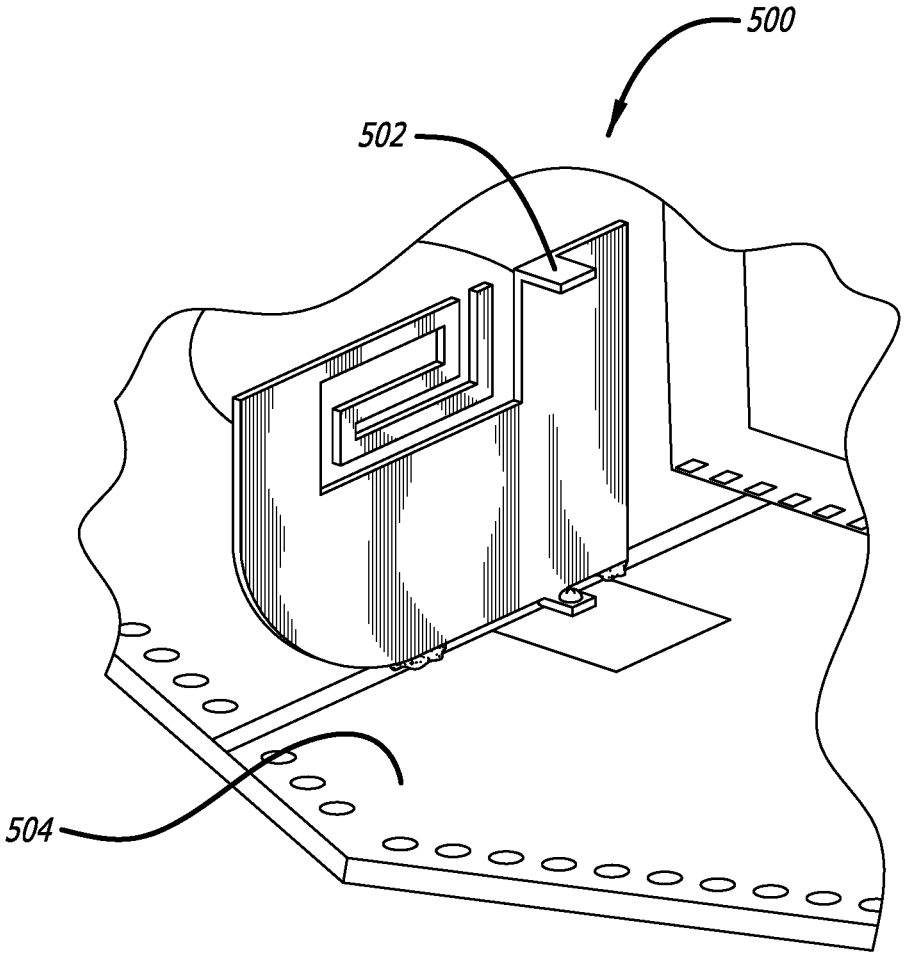
FIG. 5 is a perspective side view of an example dual-band monopole antenna element in accordance with the present invention mounted on a printed circuit board.

FIG. 5 is a top perspective side view 500 of an example dual-band monopole antenna element 502 in accordance with the present invention mounted on a printed circuit board 504. The printed circuit board 504 may include a conductive ground plane (not shown), which may be a large area of copper foil on the printed circuit board 504, connected to a power supply ground terminal. The dual-band monopole antenna element 502 (which is described in more detail below with reference to FIGS. 10B and 10C) is affixed to the printed circuit board 504 at its perimeter as shown in FIG. 5 and additional dual-band monopole antenna elements may be likewise affixed to the printed circuit board 504 as shown in FIG. 9.

Figure 6:
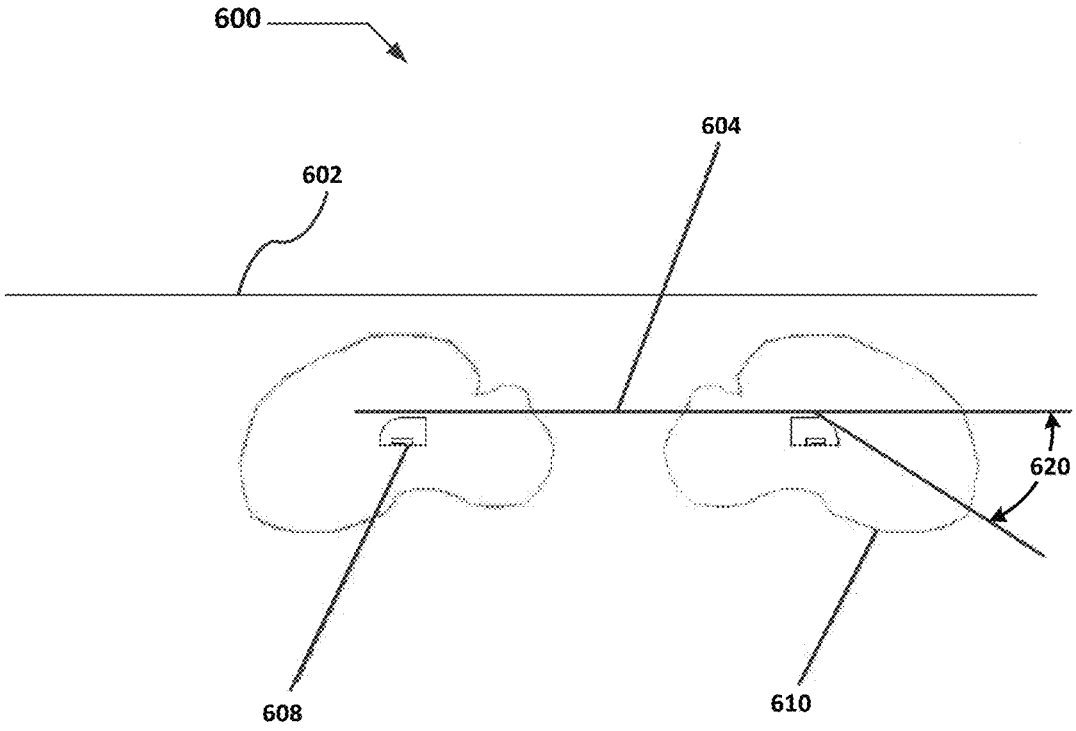
FIG. 6 is a section side view of an example radiation pattern of the elevation coverage for the APs shown in FIGS. 1 and 2 when mounted on a ceiling.

FIG. 6 is a sectional side view 600 of an example radiation pattern of the elevation coverage for the APs shown in FIGS. 1 and 2 when mounted on a ceiling 602. The APs may include a ground plane 604 positioned above a dual-band monopole antenna element 608 affixed to a printed circuit board (not shown). The use of the ground plane 604 may deflect the radiation patterns 608 and 610 down by about 5-25 degrees, as shown by angle 620, thus maximizing coverage below the antennas of the AP. The radiation pattern of the elevation coverage of the antenna element is dependent on the size and shape of the ground plane, which may vary based on design requirements.

Figure 7:
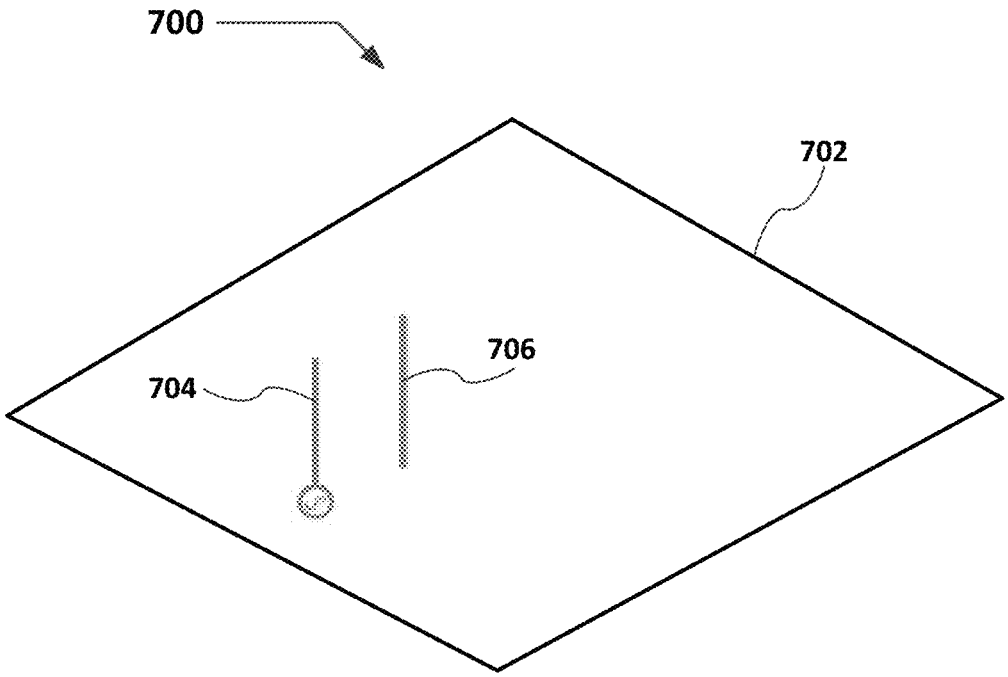
FIG. 7 is a sketch showing a perspective top view of a ground plane having an dual-band monopole antenna in accordance with the present invention together with a wire reflector.
Figure 8:
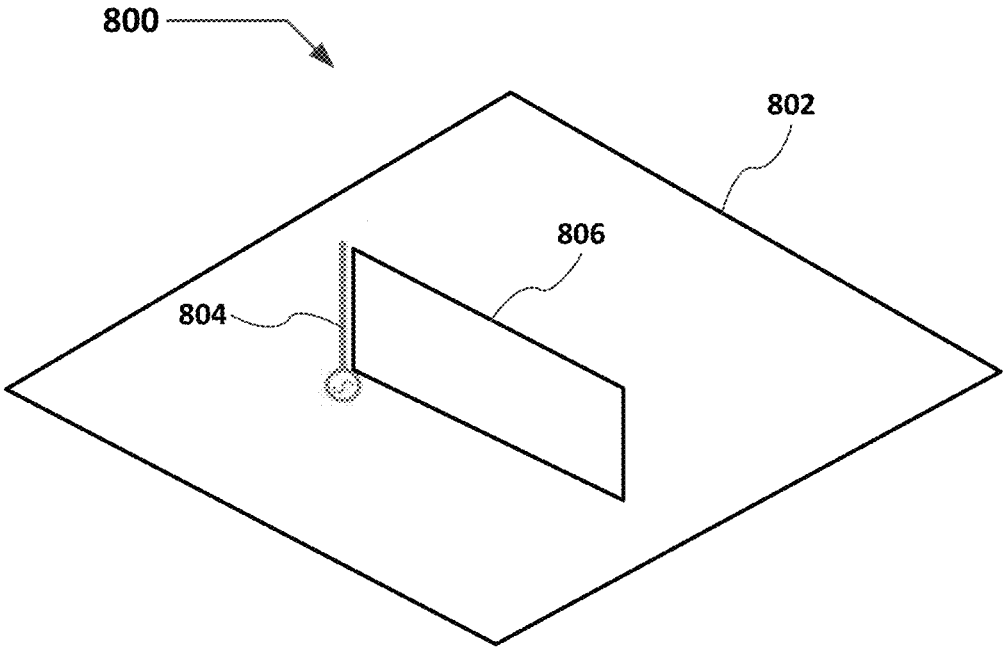
FIG. 8 is sketch showing a perspective top view of a ground plane having an dual-band monopole antenna in accordance with the present invention together with a sheet reflector.

The monopole elements may also have a reflector behind it to enhance its directivity. The reflector could be a continuous metallic wall or a single wire reflector (see FIGS. 7 and 8, respectively). FIG. 7 is a sketch showing a perspective top view of a ground plane 702 having a dual-band monopole antenna 704 in accordance with the present invention together with a single wire reflector 706. FIG. 8 is sketch showing a perspective top view of a ground plane 802 having a dual-band monopole antenna 704 in accordance with the present invention together with a metallic sheet reflector 806.

Figure 9:
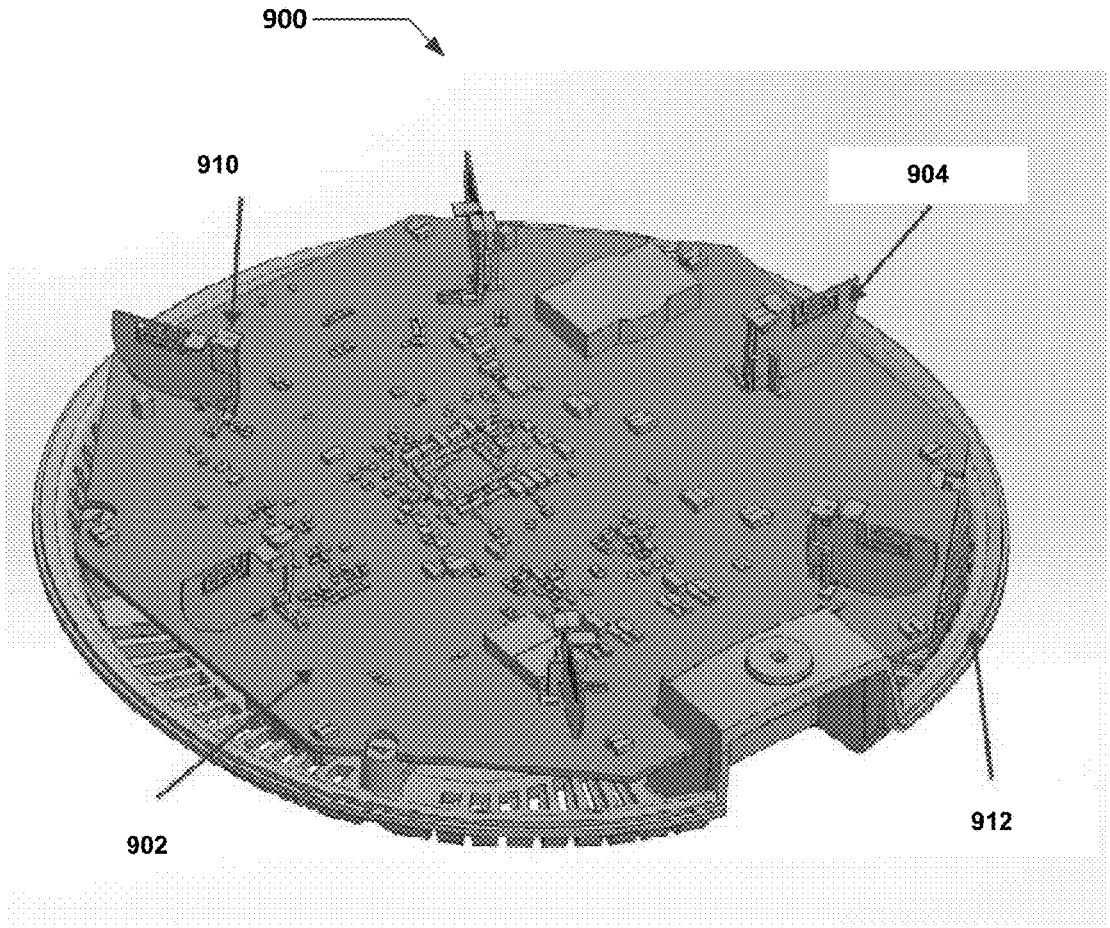
FIG. 9 is perspective top view of an access point in accordance with the present invention comprising a printed circuit board mounted on a plastic enclosure, having six dual-band monopole antennas in accordance with the present invention mounted on the printed circuit board.

FIG. 9 is perspective top view of an access point 900 in accordance with the present invention comprising a printed circuit board 902 mounted on a plastic enclosure 904, having six dual-band monopole antennas 904 in accordance with the present invention mounted on the printed circuit board 902. The AP is an integrated assembly, and this embodiment is designed for mounting on a ceiling, as shown in FIG. 6, wherein the plastic support 910 assists in stabilizing the access point 900 against the ceiling.

Figure 10A:
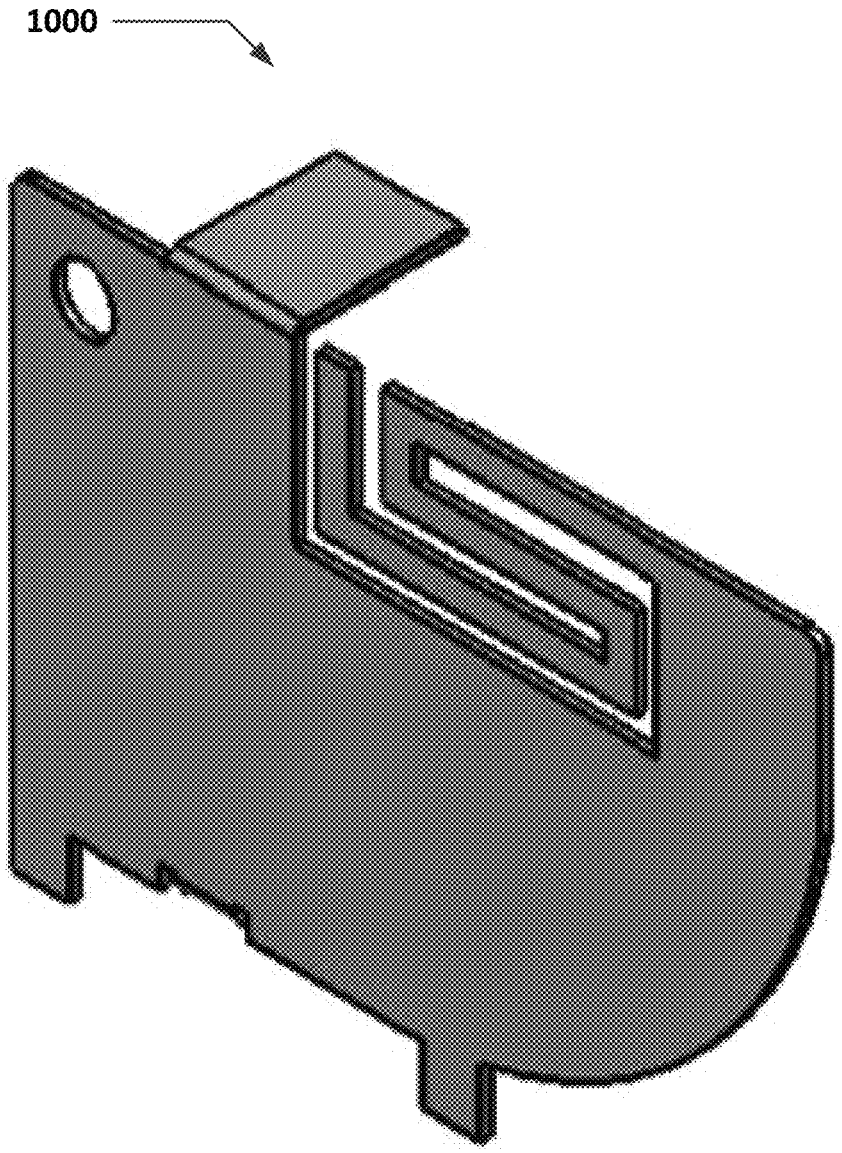
FIG. 10A is a perspective side view of an example of an implementation of an dual-band monopole antenna in accordance with the present invention.

FIG. 10A is a perspective side view of an example of an implementation of a dual-band monopole antenna 1000 in accordance with the present invention. In general, this dual-band monopole antenna 1000 is roughly rectangular in shape. One portion of the dual-band monopole antenna may be formed as a convex curve that forms a tapered slot antenna having a broad bandwidth that includes the 5 GHz WiFi band. Another portion of the antenna element may be formed into an S-shaped folded stub that creates a resonance at the 2.4 GHz WiFi band. The dual-band monopole antenna may be printed on a FR4 substrate of relative permittivity 4.4 and thickness 1.6 mm as shown in thickness 1050 of FIG. 10C. A 50-Ohm microstrip line may be used for the excitation, with a strip width of 3.06 mm, same as that of the width of the microstrip feed line.

Figure 10B:
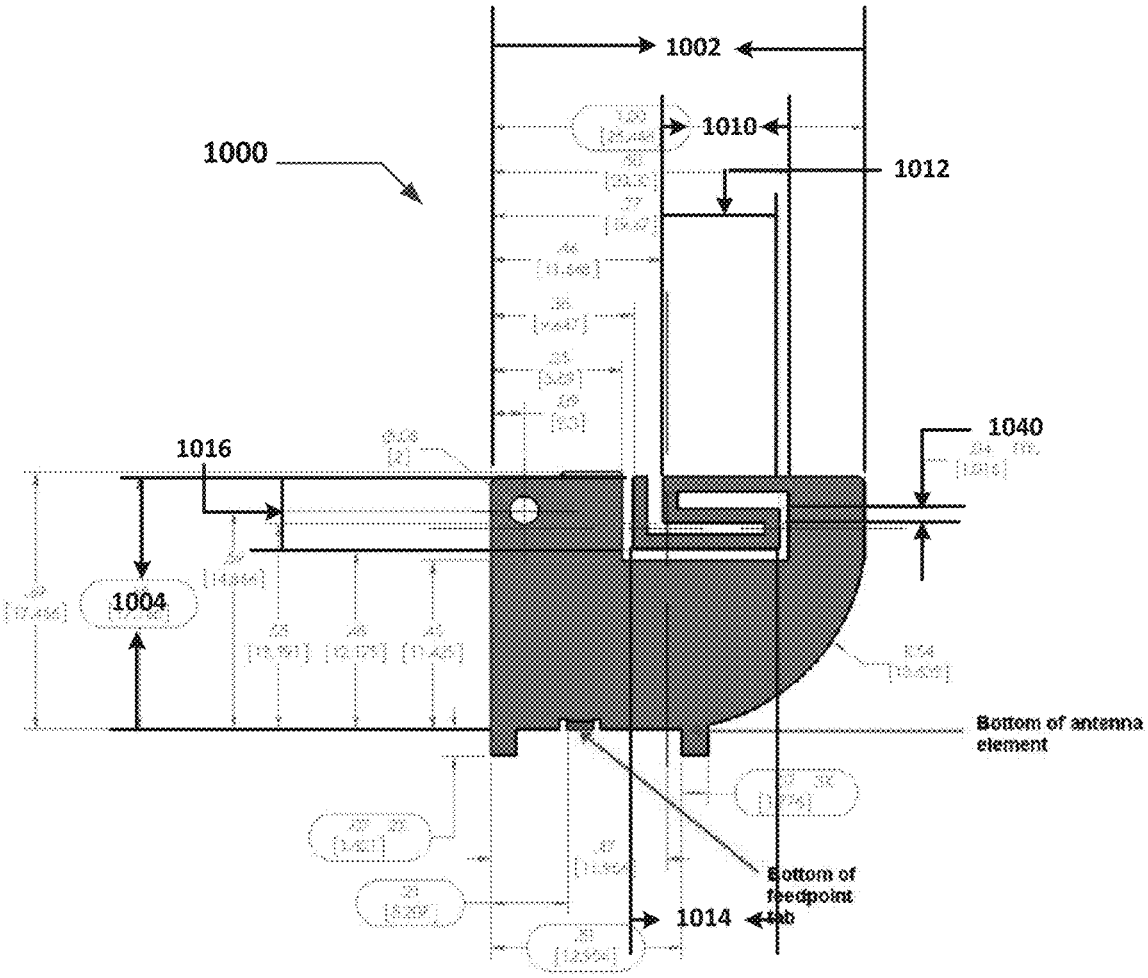
FIG. 10B is a side view, with dimensions, of the dual-band monopole antenna shown in FIG. 10A.
Figure 10C:
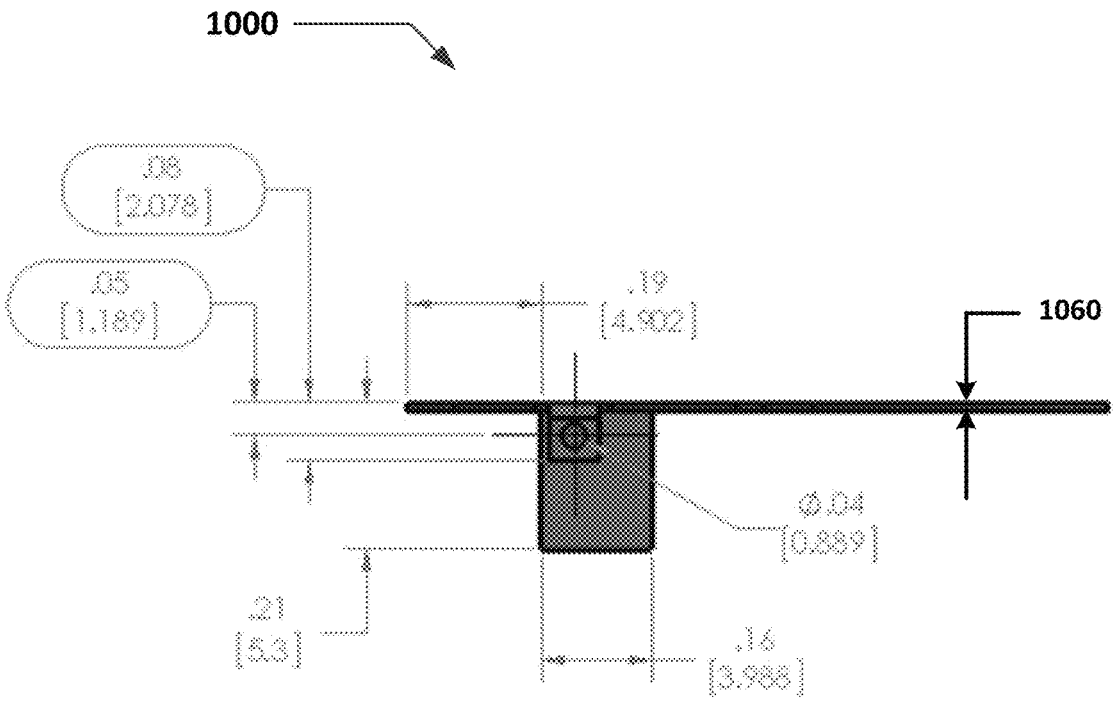
FIG. 10C is a top view, with selected dimensions, of the dual-band monopole antenna shown in FIG. 10A.

Turning to FIG. 10B, this particular embodiment of a dual-band monopole antenna 1000 has a width 1002 of 25.448 mm and a length 1004 of 17.166 mm. This dual-band monopole antenna 1000 comprises a folded stub including three horizontal radiating elements and one vertical radiating element, as shown in FIG. 10B. The shape of the radiating elements of the folded stub when connected looks like the letter "S" with the vertical radiating element perpendicular to the open end of the bottom-most third horizontal radiating element. The first horizontal radiating element has a length 1010 of 8.652 mm; the second horizontal radiating element has a length 1012 of 8.002 mm; the third horizontal radiating element has a length 1014 of 10.023 mm; and the vertical radiating element has a length 1016 of 5.741 mm. The width 1040 of the radiating elements is 1.016 mm. The first horizontal radiating element and the second horizontal radiating element are connected by a first connecting element having a length of 1.143 mm, and the second horizontal radiating element and the third horizontal radiating element are connected by a second connecting element having a length of 0.800 mm.

The antenna gain may be in the 2.4 and 5 GHz bands may 2-5 dB. The isolation between any antenna in the array of antennas is high, reaching, for example, approximately 40 dB at the 5 GHz band. The high isolation between these antennas enables the two radios in the AP to coexist with each other. By having the antennas interleaved, it creates an effect of distributed omni-coverage, where the two or three antennas connected to a specific radio forms an omni-directional coverage.

It will be understood that the foregoing description of numerous implementations has been presented for purposes of illustration and description. It is not exhaustive and does not limit the claimed inventions to the precise forms disclosed. For example, the above examples have been described as implemented according to IEEE 802.11a and 802.11bg. Other implementations may use other standards. In addition, examples of the wireless access points described above may use housings of different shapes, not just a round housing. The number of radios in the sectors and the number of sectors defined for any given implementation may also be different. Modifications and variations are possible in light of the above description or may be acquired from practicing the invention. The claims and their equivalents define the scope of the invention.

What is claimed is:

1. A distributed omni-directional dual-band antenna system for use in a Wi-Fi access point, the distributed omni-directional dual-band antenna system comprising:

a plurality of radios; and a plurality of dual-band antennas;

wherein each radio of the plurality of radios is associated with two or more dual-band antennas of the plurality of dual-band antennas, the plurality of dual-band antennas are arranged equidistantly in a circular array along a perimeter of the Wi-Fi access point, and the two or more dual-band antennas associated with each radio are interleaved with dual-band antennas associated with a different radio.

2. The distributed omni-directional dual-band antenna system of claim 1, wherein the plurality of radios comprises two radios and the plurality of dual-band antennas comprises four dual-band antennas, with two dual-band antennas associated with each of the two radios.

3. The distributed omni-directional dual-band antenna system of claim 1, wherein the plurality of radios comprises two radios and the plurality of dual-band antennas comprises six dual-band antennas, with three dual-band antennas associated with each of the two radios.

4. The distributed omni-directional dual-band antenna system of claim 1, wherein the plurality of radios comprises two radios and the plurality of dual-band antennas comprises eight dual-band antennas, with four dual-band antennas associated with each of the two radios.

5. The distributed omni-directional dual-band antenna system of claim 1, further comprising a ceiling conductive ground plane, below which the distributed omni-directional dual-band antenna system is mounted.

6. The distributed omni-directional dual-band antenna system of claim 1, wherein each of the plurality of dual-band antennas is a directional dual-band monopole antenna.

7. The distributed omni-directional dual-band antenna system of claim 6, wherein each directional dual-band monopole antenna is configured to generate a beam directed outward from the perimeter of the Wi-Fi access point.

8. The distributed omni-directional dual-band antenna system of claim 7, wherein each directional dual-band monopole antenna is configured to provide 2 to 5 dB of antenna gain in the 2.4 GHz and 5 GHz Wi-Fi bands.

9. The distributed omni-directional dual-band antenna system of claim 6, further comprising a respective single wire reflector associated with each dual-band monopole antenna.

10. The distributed omni-directional dual-band antenna system of claim 6, further comprising a respective metallic sheet reflector associated with each dual-band monopole antenna.

* * * * *